US010559282B2

(12) United States Patent
Shang et al.

(10) Patent No.: US 10,559,282 B2
(45) Date of Patent: Feb. 11, 2020

(54) PIXEL DRIVING CIRCUITS FOR SWITCHING DISPLAY RESOLUTION, DRIVING METHODS THEREOF AND DISPLAY APPARATUSES

(71) Applicant: BOE TECHNOLOGY GROUP CO., LTD., Beijing (CN)

(72) Inventors: Guangliang Shang, Beijing (CN); Jung Chul Gyu, Beijing (CN); Seung Woo Han, Beijing (CN); Haoliang Zheng, Beijing (CN); Mingfu Han, Beijing (CN); Zhihe Jin, Beijing (CN); Im-Yun- Sik, Beijing (CN); Jing Lv, Beijing (CN); Xue Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 44 days.

(21) Appl. No.: 15/793,957

(22) Filed: Oct. 25, 2017

(65) Prior Publication Data

US 2018/0286303 A1 Oct. 4, 2018

(30) Foreign Application Priority Data

Mar. 29, 2017 (CN) ..... 2017 1 0198860

(51) Int. Cl.
*G09G 5/22* (2006.01)
*G09G 3/20* (2006.01)
(Continued)

(52) U.S. Cl.
CPC ..... *G09G 5/227* (2013.01); *G09G 3/20* (2013.01); *G09G 3/2092* (2013.01);
(Continued)

(58) Field of Classification Search
CPC .... G09G 5/227; G09G 5/391; G09G 2340/04; G09G 2340/0407; G09G 2340/0414;
(Continued)

(56) References Cited

U.S. PATENT DOCUMENTS

2002/0000970 A1* 1/2002 Akimoto ..... G09G 3/3648 345/100
2003/0214476 A1* 11/2003 Matsuda ..... G09G 3/3688 345/100
(Continued)

FOREIGN PATENT DOCUMENTS

CN 1460982 A 12/2003
CN 1501706 A 6/2004
(Continued)

OTHER PUBLICATIONS

First Chinese Office Action dated Jul. 2, 2019, received for corresponding Chinese Application No. 201710198860.4.

*Primary Examiner* — Darlene M Ritchie
(74) *Attorney, Agent, or Firm* — Kinney & Lange, P.A.

(57) ABSTRACT

The present disclosure relates to a pixel driving circuit for switching display resolution, a driving method thereof, and a display apparatus. The pixel driving circuit comprises: r first data lines and k second data lines, each of the first data lines has a first switch provided thereon, and is connected to at least one of the k second data lines through at least one second switch respectively, and the first switch and the second switch are connected to a signal control unit which is configured to control the first switch to be turned on and the second switch to be turned off when display is to be performed at a first resolution, and control the first switch to be turned off and the second switch to be turned on when display is to be performed at a second resolution.

20 Claims, 2 Drawing Sheets

(51) Int. Cl.
*G09G 5/00* (2006.01)
*G09G 3/36* (2006.01)

(52) U.S. Cl.
CPC ..... *G09G 3/3685* (2013.01); *G09G 5/003* (2013.01); *G09G 3/3614* (2013.01); *G09G 2300/0452* (2013.01); *G09G 2300/0809* (2013.01); *G09G 2310/0243* (2013.01); *G09G 2310/0275* (2013.01); *G09G 2310/0291* (2013.01); *G09G 2330/021* (2013.01); *G09G 2340/0421* (2013.01)

(58) Field of Classification Search
CPC ... G09G 2340/0421; G09G 2340/0428; G09G 5/003; G09G 3/3685; G09G 3/2092
See application file for complete search history.

(56) References Cited

U.S. PATENT DOCUMENTS

2004/0008173 A1* 1/2004 Maeda ..... G09G 3/3688 345/99
2004/0130520 A1* 7/2004 Maeda ..... G09G 3/20 345/100
2005/0179640 A1* 8/2005 Tanaka ..... G09G 3/3666 345/103
2006/0114210 A1* 6/2006 Chen ..... G09G 3/3611 345/98
2007/0229687 A1 10/2007 Hiyama et al.
2008/0218500 A1 9/2008 Akai et al.
2009/0128723 A1* 5/2009 Saito ..... G09G 3/3655 349/37
2012/0206510 A1* 8/2012 Furuta ..... G09G 3/3614 345/690
2012/0287147 A1* 11/2012 Brown Elliott ..... G09G 5/02 345/593
2016/0171938 A1 6/2016 Na et al.
2017/0200415 A1* 7/2017 Noguchi ..... G09G 3/3258
2017/0358268 A1* 12/2017 Nishio ..... G09G 3/20
2018/0158424 A1* 6/2018 Okamoto ..... G09G 5/391
2018/0211579 A1* 7/2018 Bae ..... G09G 3/3607

FOREIGN PATENT DOCUMENTS

CN 101047797 A 10/2007
CN 101261801 A 9/2008
CN 106531110 A 3/2017
JP 6418193 A 1/1989

* cited by examiner

PIXEL DRIVING CIRCUITS FOR SWITCHING DISPLAY RESOLUTION, DRIVING METHODS THEREOF AND DISPLAY APPARATUSES

CROSS-REFERENCE TO RELATED APPLICATION(S)

The present application claims priority to the Chinese Patent Application No. 201710198860.4, filed on Mar. 29, 2017, entitled "PIXEL DRIVING CIRCUITS, DRIVING METHODS THEREOF AND DISPLAY APPARATUSES," which is incorporated herein by reference in its entirety.

TECHNICAL FIELD

The present disclosure relates to the field of display technology, and more particularly, to a driving circuit, a driving method thereof, and a display apparatus.

BACKGROUND

A maximum number of pixels which may be displayed on a display screen is called a physical resolution of the display screen, which is a parameter inherent to the display screen. In order to reduce power consumption of a display system under the premise of guaranteeing display quality of an area of concern to human eyes, resolutions of other areas may be reduced.

SUMMARY

The present disclosure provides a pixel driving circuit, a driving method thereof, and a display apparatus, to realize switch between display resolutions.

According to an aspect of the present disclosure, there is provided a pixel driving circuit, comprising: N data lines at least comprising r first data lines and k second data lines, wherein each of the first data lines has a first switch unit provided thereon, wherein each of the first data lines corresponds to at least one of the k second data lines, and is connected to the at least one of the k second data lines through at least one second switch unit, where $r+k \leq N$, r, k, and q are integers greater than 0, and $k=r*q$; and the first switch unit and the second switch unit are connected to a signal control unit respectively, and the signal control unit is configured to control the first switch unit to be turned on and the second switch unit to be turned off when display is to be performed at a first resolution, and the signal control unit is further configured to control the first switch unit to be turned off and the second switch unit to be turned on when display is to be performed at a second resolution, wherein the first resolution is greater than the second resolution.

According to the present disclosure, when $r+k<N$, in addition to the r first data lines and the k second data lines, the N data lines in the pixel driving circuit comprise remaining $N-r-k$ data lines. With respect to the remaining $N-r-k$ data lines, conventional signal control devices may be provided on the remaining $N-r-k$ data lines so that these signal control devices are used in cooperation with the first switch unit and the second switch unit respectively to realize multi-resolution display. The remaining $N-r-k$ data lines may also normally output data, and the display apparatus which is driven by the pixel driving circuit according to the present disclosure can display at different resolutions only through operations of the first switch unit and the second switch unit.

According to another aspect of the present disclosure, there is provided a pixel driving method applied to the pixel driving circuit described above, comprising:

controlling, by the signal control unit, the first switch unit to be turned on and the second switch to be turned off when display is to be performed at the first resolution; and controlling, by the signal control unit, the first switch unit to be turned off and the second switch to be turned on when display is to be performed at the second resolution.

According to a further aspect of the present disclosure, there is provided a display apparatus, comprising the pixel driving circuit described above.

BRIEF DESCRIPTION OF THE DRAWINGS

The accompanying drawings described herein are used to provide a further understanding of the present disclosure. The illustrative embodiments of the present disclosure and the description thereof are intended to explain the present disclosure and are not to be construed as limiting the present disclosure. In the accompanying drawings.

DETAILED DESCRIPTION

In order to further illustrate the pixel driving circuit, the driving method thereof and the display apparatus according to the embodiments of the present disclosure, the following description will be made in detail with reference to the accompanying drawings.

Figure 1:
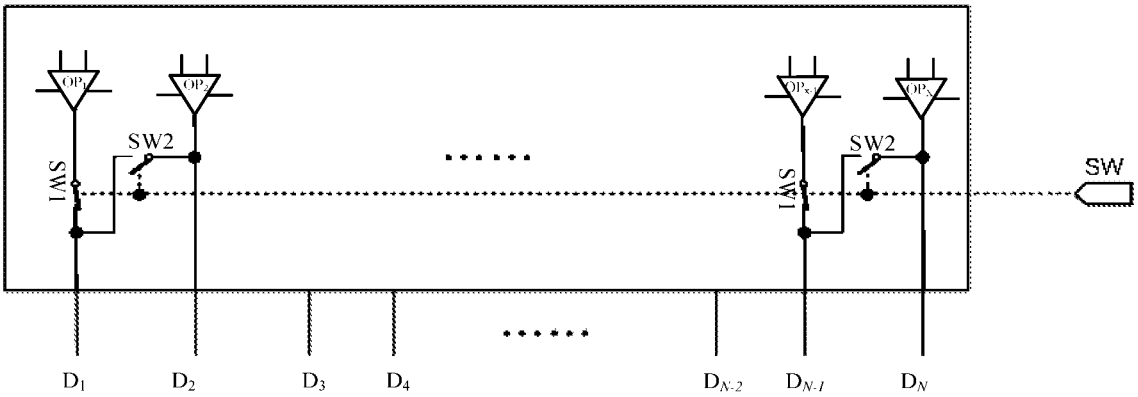
FIG. 1 is a structural diagram of a pixel driving circuit according to an embodiment of the present disclosure.

As shown in FIG. 1, a pixel driving circuit according to the embodiments of the present disclosure may comprise N data lines which are denoted by $D_1, D_2, \ldots, D_{N-2}, D_{N-1}$ and $D_N$ in turn in FIG. 1. The N data lines at least comprise r first data lines and k second data lines, wherein each of the first data lines has a first switch unit provided thereon, corresponds to q second data lines, and is connected to the q second data lines through a second switch unit, where $r+k \leq N$, r, k, and q are integers greater than 0, and $k=r*q$.

The first switch unit and the second switch unit are connected to a signal control unit SW respectively, wherein the signal control unit SW is configured to control the first switch unit to be turned on and the second switch unit to be turned off when display is to be performed at a first resolution. The signal control unit SW is further configured to control the first switch unit to be turned off and the second switch unit to be turned on when display is to be performed at a second resolution, wherein the first resolution is greater than the second resolution.

When display is to be performed at the first resolution, the signal control unit SW controls the first switch unit to be turned on and the second switch unit to be turned off. When display is to be performed at the second resolution, the signal control unit SW controls the first switch unit to be turned off and the second switch unit to be turned on.

In the pixel driving circuit according to the present disclosure, r first data lines and k second data lines are provided, and when r+k=N, each of the first data lines has a first switch unit provided thereon and is connected to corresponding q second data lines through a second switch unit. When display is to be performed at a higher first resolution, the signal control unit SW may control the first switch unit to be turned on and the second switch unit to be turned off, so that a pixel unit is driven individually by each of the first data lines and corresponding second data lines respectively, thereby driving a display panel to display at the higher first resolution. When display is to be performed at a lower second resolution, the signal control unit SW controls the first switch unit to be turned off and the second switch unit to be turned on, so that the first data line is connected to the corresponding q second data lines through the second switch unit, and data output is shared by each of the first data lines and the corresponding q second data lines, thereby transmitting the same data driving signal through a plurality of data lines. In this case, a plurality of pixels corresponding to the plurality of data lines are considered to be one pixel, which is equivalent to reducing a number of pixels per area, i.e., realizing display at the lower second resolution. Therefore, in the pixel driving circuit according to the embodiments of the present disclosure, operations of the first switch unit and the second switch unit are controlled by the signal control unit SW, so that the display apparatus which is driven by the pixel driving circuit can realize display at different resolutions.

When r+k<N, in addition to the r first data lines and the k second data lines, the N data lines in the pixel driving circuit comprise remaining N−r−k data lines. With respect to the remaining N−r−k data lines, conventional signal control devices may be provided on the remaining N−r−k data lines so that these signal control devices are used in cooperation with the first switch unit and the second switch unit respectively to realize multi-resolution display. The remaining N−r−k data lines may also normally output data, and the display apparatus which is driven by the pixel driving circuit according to the embodiments of the present disclosure can display at different resolutions only through operations of the first switch unit and the second switch unit.

It can be understood that in the present disclosure, a current first data line is an $i^{th}$ data line in the N data lines, so that the q second data lines corresponding to the current first data line is a $j^{th}$ data line to a $(j+q-1)^{th}$ data line. When q=1, that is, when the first data line in the N data lines corresponds to a second data line, the following two cases are included.

In a first case, when j=i+1, the current first data line is the $i^{th}$ data line and the second data line is an $(i+1)^{th}$ data line. That is, the second data line is arranged adjacent to the first data line in this case.

For example, when i=1, that is, when the current first data line is a first data line and the second data line is a second data line, a structure of the pixel driving circuit is shown in FIG. 1. When display is to be performed at the first resolution, the signal control unit SW controls the first switch unit to be turned on and the second switch unit to be turned off. In this case, a pixel unit is driven individually by the first data line and the second data line respectively, so that the display panel which is driven by the pixel driving circuit displays at the higher first resolution. When display is to be performed at the second resolution, the signal control unit SW controls the first switch unit to be turned off and the second switch unit to be turned on, so that the first data line is connected to the second data line through the second switch unit, and data output is shared by the first data line and the second data line, to realize display at the lower second resolution.

In a second case, when j=i+m−1 and m>2, that is, when the current first data line is the $i^{th}$ data line, the second data line corresponding to the current first data line is an $(i+m-1)^{th}$ data line. In this case, the second data line connected to the first data line through the second switch unit is separated from the first data line by m−2 data lines.

Figure 2:
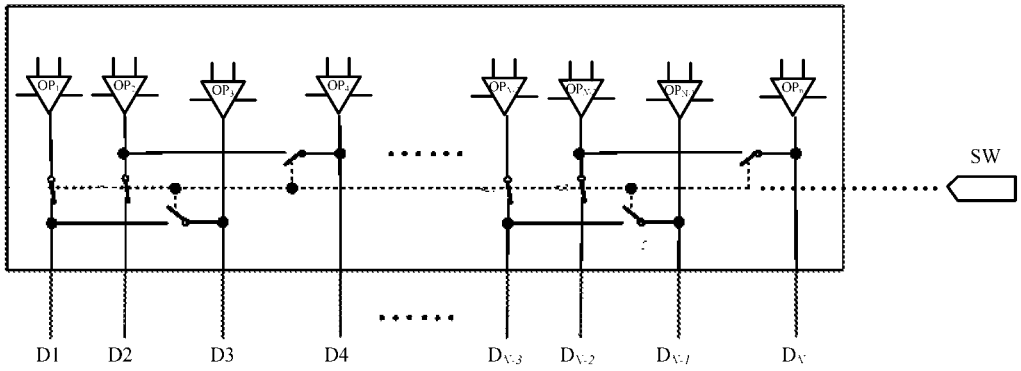
FIG. 2 is a structural diagram of a pixel driving circuit according to another embodiment of the present disclosure.

For example, when i=1 and m=3, that is, when the current first data line is a first data line and the second data line is a third data line, a structure of the pixel driving circuit is as shown in FIG. 2. When i=1 and m=4, the pixel unit may comprise a red sub-pixel, a green sub-pixel, and a blue sub-pixel. When i=1 and m=5, the pixel unit may comprise a red sub-pixel, a green sub-pixel, a blue sub-pixel, and a white sub-pixel. When display is to be performed at the first resolution, the signal control unit SW controls the first switch unit to be turned on and the second switch unit to be turned off. In this case, the pixel unit is driven individually by the first data line and the second data line respectively, so that the display panel which is driven by the pixel driving circuit displays at the higher first resolution. When display is to be performed at the second resolution, the signal control unit SW controls the first switch unit to be turned off and the second switch unit to be turned on, so that the first data line is connected to the second data line through the second switch unit, and data output is shared by the first data line and the second data line, to realize display at the lower second resolution.

In addition, when q≥2, that is, when each of the first data lines in the N data lines is connected to at least two second data lines through the second switch unit, there are cases as follows.

In a case, when j=i+1, the current first data line is the $i^{th}$ data line, and the q second data lines corresponding to the current first data line are an $(i+1)^{th}$ data line to an $(i+q)^{th}$ data line. In this case, the at least two second data lines corresponding to the first data line are arranged adjacent to the first data line.

For example, when q=3 and i=1, that is, when each of the first data lines in the N data lines is connected to three second data lines through the second switch unit, the current first data line is a first data line, and the three second data lines corresponding to the current first data line are a second data line, a third data line and a fourth data line. When display is to be performed at the first resolution, the signal control unit SW controls the first switch unit to be turned on and the second switch unit to be turned off. In this case, the pixel unit is driven individually by the first data line and the second data lines respectively, so that the display panel which is driven by the pixel driving circuit displays at the higher first resolution. When display is to be performed at the second resolution, the signal control unit SW controls the first switch unit to be turned off and the second switch unit to be turned on, so that the first data line is connected to the second data lines through the second switch unit, and data output is shared by the first data line and the second data lines, to realize display at the lower second resolution.

In another case, when j=i+m−1 and m>2, the q second data lines corresponding to the current first data line are an $(i+m-1)^{th}$ data line to an $(i+q+m-2)^{th}$ data line.

For example, when q=3, i=1 and m=3, that is, when each of the first data lines in the N data lines is connected to three second data lines through the second switch unit, the current first data line is a first data line, and the second data lines are a third data line, a fourth data line and a fifth data line. When display is to be performed at the first resolution, the signal control unit SW controls the first switch unit to be turned on and the second switch unit to be turned off. In this case, the pixel unit is driven individually by the first data line and the second data lines respectively, so that the display panel which is driven by the pixel driving circuit displays at the higher first resolution. When display is to be performed at the second resolution, the signal control unit SW controls the first switch unit to be turned off and the second switch unit to be turned on, so that the first data line is connected to the second data lines through the second switch unit, and data output is shared by the first data line and the second data lines, to realize display at the lower second resolution.

In another case, when j=i+m−1 and m>2, the q second data lines corresponding to the current first data line are an $(i+m-1)^{th}$ data line, an $(i+2(m-1))^{th}$ data line, an $(i+3(m-1))^{th}$ data line, . . . , an $(i+(q-1)(m-1))^{th}$ data line, and an $(i+q(m-1))^{th}$ data line. That is, a first one of the q second data lines is separated from the first data line by m−2 data lines, and adjacent two second data lines of the q second data lines are spaced by m−2 data lines. The second data lines connected to the first data line are arranged at intervals, so that when display is to be performed at the lower second resolution, data output is shared by the plurality of data lines which are arranged at equal intervals, so as to realize a more uniform display effect of the display panel which is driven by the pixel driving circuit.

For example, when q=3, i=1 and m=3, each of the first data lines in the N data lines is connected to three second data lines through the second switch unit, and the current first data line is a first data line, and the second data lines are a third data line, a fifth data line and a seventh data line. When display is to be performed at the first resolution, the signal control unit SW controls the first switch unit to be turned on and the second switch unit to be turned off. In this case, the pixel unit is driven individually by the first data line and the second data line respectively, so that the display panel which is driven by the pixel driving circuit displays at the higher first resolution. When display is to be performed at the second resolution, the signal control unit SW controls the first switch unit to be turned off and the second switch unit to be turned on, so that the first data line is connected to the second data lines through the second switch unit, and data output is shared by the first data line and the second data lines, to realize display at the lower second resolution.

Figure 5:
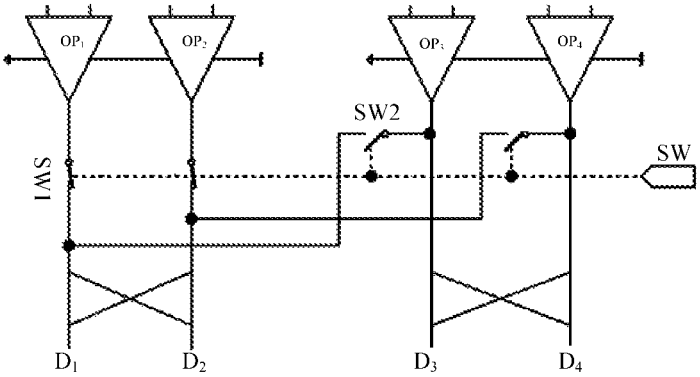
FIG. 5 is a structural diagram of a pixel driving circuit according to another embodiment of the present disclosure.

As shown in FIG. 5, the first data lines comprise an $i^{th}$ data line and an $(i+1)^{th}$ data line (e.g. data lines D1 and D2 in FIG. 5). The first switch unit comprises a first switch SW1 which is provided on respective first data line. As shown in FIG. 5, each of the data lines D1 and D2 has a respective first switch SW1 provided thereon.

The data line D1 has one terminal connected to a voltage output terminal of the pixel driving circuit in order to output data driving signal to a corresponding thin film transistor in the display panel, and the other terminal connected to a voltage output terminal of the operational amplifier $OP_1$. The operational amplifier $OP_2$ has a voltage output terminal connected to one terminal of the data line D2, the data line D2 has the other terminal connected to a voltage output terminal of the pixel driving circuit in order to output data driving signal to a corresponding thin film transistor in the display panel. Each of the operational amplifiers $OP_1$ and $OP_2$ has a first power supply input terminal connected to a power supply and a second power supply input terminal connected to the ground.

As shown in FIG. 5, the second data lines comprises a $i^{th}$ data line and a $(j+1)^{th}$ data line (e.g. data lines D3 and D4 in FIG. 5), and the second switch unit comprises a second switch SW2.

The data line D3 has one terminal connected to a voltage output terminal of the pixel driving circuit in order to output data driving signal to a corresponding thin film transistor in the display panel, and the other terminal connected to a voltage output terminal of the operational amplifier $OP_3$. The operational amplifier $OP_4$ has a voltage output terminal connected to one terminal of the data line D4. The data line D4 has the other terminal connected to a voltage output terminal of the pixel driving circuit in order to output data driving signal to a corresponding thin film transistor in the display panel. Each of the operational amplifiers $OP_3$ and $OP_4$ has a first power supply input terminal connected to the power supply, and a second power supply input terminal connected to the ground. The first switches SW1 and the second switches SW2 are connected to the signal control unit SW respectively.

The signal control unit SW is configured to output a first level signal under the first resolution, so that the first level signal controls the first switch to be turned on and the second switch to be turned off.

The signal control unit SW is further configured to output a second level signal when display is to be performed at the second resolution, so that the second level signal controls the first switch to be turned off and the second switch to be turned on. The signal control unit SW may be used to output the first level signal under the first resolution, so that the first level signal controls the first switch SW1 to be turned on and the second switch SW2 to be turned off. In this case, the pixel unit is driven individually by each of the first data lines and corresponding second data lines respectively, so that the display apparatus which is driven by the pixel driving circuit realizes display at the higher first resolution. Similarly, the signal control unit SW may be used to output the second level signal under the second resolution, so that the second level signal controls the first switch to be turned off and the second switch to be turned on, so as to enable the pixel driving circuit to realize an effect of display at the second resolution.

The second switch SW2 is connected to the data line D1 and the data line D3; or the second switch SW2 is connected to the data line D1 and the data line D4; or the second switch SW2 is connected to the data line D2 and the data line D3; or the second switch SW2 is connected to the data line D2 and the data line D4.

Figure 4:
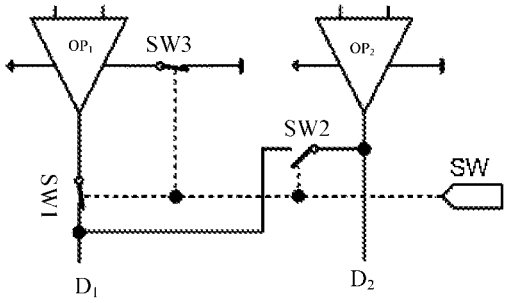
FIG. 4 is a structural diagram of a pixel driving circuit according to another embodiment of the present disclosure.

For example, the first power supply input terminal of the first operational amplifier $OP_1$ or the second operational amplifier $OP_2$ is further connected to a third switch. As shown in FIG. 4, illustrated is a condition that the first power supply input terminal of the second operational amplifier $OP_2$ is connected to the third switch SW3 which is connected to the signal control unit SW. The signal control unit SW is further configured to output a first level signal under the first resolution, so that the first level signal controls the third switch SW3 to be turned on. The signal control unit SW is configured to output a second level signal under the second resolution, so that the second level signal controls the third switch SW3 to be turned off.

For example, when display is to be performed at the first resolution, the signal control unit SW controls the third switch unit SW3 to be turned on. When display is to be performed at the second resolution, the signal control unit SW controls the third switch unit SW3 to be turned off.

According to the pixel driving circuit of the present disclosure, the third switch SW3 is provided at the first power supply input terminal of the first operational amplifier $OP_1$ or the second operational amplifier $OP_2$. Therefore, when display is to be performed at the first resolution, the first level signal output by the signal control unit SW is used to enable the third switch SW3 to be turned on. The pixel driving circuit according to the present disclosure operates normally under the first resolution even if power is normally supplied by the power supply to the first operational amplifier $OP_1$ or the second operational amplifier $OP_2$ connected to the third switch SW3. In addition, the pixel driving circuit may enables the third switch SW3 to be turned off using the second level signal output by the signal control unit SW when display is to be performed at the second resolution, so that the power supply is disconnected from the first operational amplifier $OP_1$ or the second operational amplifier $OP_2$ which is connected to the third switch SW3. In this way, the pixel driving circuit according to the present disclosure operates normally under the second resolution and the power consumption of the pixel driving circuit is reduced.

It can be understood that the first switch is an N-type transistor, the second switch is a P-type transistor, and the third switch is an N-type transistor. Alternatively, the first switch is a P-type transistor, the second switch is an N-type transistor, and the third switch is a P-type transistor.

In addition, the pixel driving circuit further comprises a voltage signal control unit connected to each of the data lines. The voltage signal control unit is configured to control a data line to output a display signal according to an input voltage. For example, a $2i^{th}$ data line and a $(2i+1)^{th}$ data line are connected to the voltage signal control unit through at least one connection line respectively. The voltage signal control unit is configured to control the $2i^{th}$ data line to output a display signal when the input voltage is a first voltage signal and control the $(2i+1)^{th}$ data line to output a display signal when the input voltage is a second voltage signal. For example, the first voltage signal may correspond to a positive polarity voltage, and the second voltage signal may correspond to a negative polarity voltage. As shown in FIG. 5, data lines D1 and D2 are connected to the voltage signal unit, which controls data line D1 to output a display signal when the input voltage is a negative polarity voltage, and control data line D2 to output a display signal when the input voltage is a positive polarity voltage. Similarly, data lines D3 and D4 are connected to the voltage signal unit, which controls the data line D3 to output a display signal when the input voltage is a negative polarity voltage, and control the data line D4 to output a display signal when the input voltage is a positive polarity voltage. In some embodiments, data lines controlled by voltage of the same polarity to output display signals are connected with each other. As shown in FIG. 5, data lines D1 and D3 (both of them are controlled by negative polarity voltage) are connected with each other through a second switch SW2, and the data lines D1 and D3 (both of them are controlled by positive polarity voltage) are connected with each other through another second switch SW2. In FIG. 5, a first power supply input terminal of the operational amplifier $OP_1$ is a connected to a second power supply input terminal of the operational amplifier $OP_2$, a second power supply input terminal of the operational amplifier $OP_1$ is connected to the ground, and a first power supply input terminal of the operational amplifier $OP_2$ is connected to a power supply. Similarly, a first power supply input terminal of the operational amplifier $OP_3$ is a connected to a second power supply input terminal of the operational amplifier $OP_4$, a second power supply input terminal of the operational amplifier $OP_3$ is connected to the ground, and a first power supply input terminal of the operational amplifier $OP_4$ is connected to a power supply. In FIG. 5, such relationship is denoted by the cross symbol "X" between output terminals of the two operational amplifiers (e.g. between operational amplifiers $OP_1$ and $OP_2$, or between operational amplifiers $OP_3$ and $OP_4$). In other words, the cross symbol "X" indicates that the two operational amplifiers have their power supply terminals connected in series and the two data lines (e.g. data lines D1 and D2, or data lines D3 and D4) connected to the two operational amplifies are controlled by positive polarity voltage and negative polarity voltage respectively.

In the present disclosure, the voltage signal control unit is provided in the pixel driving circuit and the $2i^{th}$ data line and the $(2i+1)^{th}$ data line are connected to the voltage signal control unit through at least one connection line respectively, so that the voltage signal control unit may be used to control the $2i^{th}$ data line to output a display signal when the input voltage is a first voltage signal and control the $(2i+1)^{th}$ data line to output a display signal when the input voltage is a second voltage signal. The pixel driving circuit according to the present disclosure realizes control of different data lines by different voltage signals, avoids the interference due to different display voltage signals, and improves the display effect of the display apparatus which is driven by the pixel driving circuit.

The present disclosure provides a pixel driving method, applied to the pixel driving circuit disclosed above. The method comprises: controlling, by the signal control unit, the first switch unit to be turned on and the second switch to be turned off when display is to be performed at a first resolution; and controlling, by the signal control unit, the first switch unit to be turned off and the second switch to be turned on when display is to be performed at a second resolution.

Figure 3:
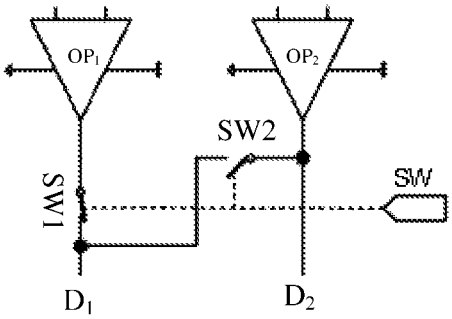
FIG. 3 is a structural diagram of a pixel driving circuit according to another embodiment of the present disclosure.

As shown in FIG. 3, in the display apparatus which is driven by the pixel driving method according to the present disclosure, the first switch unit comprises a first operational amplifier $OP_1$ and a first switch SW1, and the second switch unit comprises a second operational amplifier $OP_2$ and a second switch SW2. For example, the signal control unit outputs a first level signal when display is to be performed at the first resolution, so that the first level signal controls the first switch unit SW1 to be turned on and the second switch unit SW2 to be turned off. The signal control unit outputs a second level signal when display is to be performed at the second resolution, so that the second level signal controls the first switch unit SW1 to be turned off and the second switch unit SW2 to be turned on.

In addition, as shown in FIG. 4, the pixel driving method may comprise: outputting, by the signal control unit SW, a first level signal when display is to be performed at the first resolution, so that the first level signal controls the third switch SW3 to be turned on; and outputting, by the signal control unit SW, a second level signal when display is to be performed at the second resolution, so that the second level signal controls the third switch SW3 to be turned off.

The pixel driving method may further comprise:

controlling, by the voltage signal control unit, a $2i^{th}$ data line to output a display signal when an input voltage of the voltage signal control unit is a first voltage signal, and controlling, by the voltage signal control unit, a $(2i+1)^{th}$ data line to output a display signal when the input voltage of the voltage signal control unit is a second voltage signal.

The embodiments of the present disclosure further provide a display apparatus, comprising the pixel driving method according to the present disclosure.

In the description of the above embodiments, specific features, structures, materials, or characteristics can be combined in any one or more embodiments or examples in any suitable manner. The foregoing description is merely specific embodiments of the present disclosure, but the protection scope of the present disclosure is not limited thereto. Changes or substitutions that are readily apparent to those skilled in the art are intended to be within the protection scope of the present disclosure.

We claim:

1. A pixel driving circuit, comprising:

N operational amplifiers;

N data lines connected to the N operational amplifiers respectively, the N data lines at least comprising r first data lines and k second data lines, wherein each of the first data lines has a first switch provided thereon, wherein each of the first data lines corresponds to at least one of the k second data lines and is connected to the at least one of the k second data lines through at least one second switch respectively, where $r+k \leq N$, and $k=r*q$, wherein q is the number of the at least one of the k second data lines, wherein r, k, and q are integers greater than 0;

wherein the first switch and the second switch are connected to a signal control unit respectively, and the signal control unit is configured to control the first switch to be turned on and the second switch to be turned off when display is to be performed at a first resolution, and the signal control unit is further configured to control the first switch to be turned off and the second switch to be turned on when display is to be performed at a second resolution, wherein the first resolution is greater than the second resolution, wherein the first data lines comprise an ith data line and an (i+1)th data line of the N data lines, and the second data lines comprise a jth data line and a (j+1)th data line of the N data lines, wherein the ith data line is connected to a voltage output terminal of an ith operational amplifier of the N operational amplifiers through the first switch provided on the ith data line, and the (i+1)th data line is connected to a voltage output terminal of an (i+1)th operational amplifier of the N operational amplifiers through the first switch provided on the (i+1)th data line, the jth data line is connected to a voltage output terminal of a jth operational amplifier, and the (j+1)th data line is connected to a voltage output terminal of a (j+1)th operational amplifier, wherein each of the ith data line and the (i+1)th data line is connected to one of the jth data line and (j+1)th data line through a respective second switch; and wherein the $i^{th}$ operational amplifier has a first power supply input terminal connected to a second power supply input terminal of the $(i+1)^{th}$ operational amplifier and a second power supply input terminal connected to the ground, and the $(i+1)^{th}$ operational amplifier has a first power supply input terminal connected to a power supply and the second power supply input terminal connected to the first power supply input terminal of the $i^{th}$ operational amplifier.

2. The pixel driving circuit according to claim 1, wherein:

the $j^{th}$ operational amplifier has a first power supply input terminal connected to a second power supply input terminal of the $(j+1)^{th}$ operational amplifier and a second power supply input terminal connected to the ground, and the $(j+1)^{th}$ operational amplifier has a first power supply input terminal connected to a power supply and the second power supply input terminal connected to the first power supply input terminal of the $j^{th}$ operational amplifier;

the signal control unit is configured to output a first level signal when display is to be performed at the first resolution, so that the first level signal controls the first switch to be turned on and the second switch to be turned off; and the signal control unit is further configured to output a second level signal when display is to be performed at the second resolution, so that the second level signal controls the first switch to be turned off and the second switch to be turned on.

3. The pixel driving circuit according to claim 1, further comprising a source driver connected to each of the data lines, wherein a $2i^{th}$ data line and a $(2i+1)^{th}$ data line are connected to the source driver through at least one connection line respectively; and the source driver is configured to control the $2i^{th}$ data line to output a display signal when an input voltage is a first voltage signal and control the $(2i+1)^{th}$ data line to output the display signal when the input voltage is a second voltage signal.

4. The pixel driving circuit according to claim 1, wherein a current first data line is an $i^{th}$ data line, and q second data lines corresponding to the current first data line are a $j^{th}$ data line to a $(j+q-1)^{th}$ data line.

5. The pixel driving circuit according to claim 4, wherein:

$q=1$ and $j=i+1$, and the second data line corresponding to the current first data line is an $(i+1)^{th}$ data line; or $q=1$ and $j=i+m-1$, where $m>2$, and the second data line corresponding to the current first data line is an $(i+m-1)^{th}$ data line.

6. The pixel driving circuit according to claim 5, wherein $m=4$, and in a display apparatus driven by the pixel driving circuit, each pixel unit comprises a red sub-pixel, a green sub-pixel and a blue sub-pixel.

7. The pixel driving circuit according to claim 5, wherein $m=5$, and in a display apparatus driven by the pixel driving circuit, each pixel unit comprises a red sub-pixel, a green sub-pixel, a blue sub-pixel and a white sub-pixel.

8. The pixel driving circuit according to claim 4, wherein:

$q \geq 2$ and $j=i+1$, and the q second data lines corresponding to the current first data line are an $(i+1)^{th}$ data line to an $(i+q)^{th}$ data line; or $q \geq 2$ and $j=i+m-1$, where $m>2$, and the q second data lines corresponding to the current first data line are an $(i+m-1)^{th}$ data line to an $(i+q+m-2)^{th}$ data line; or $q \geq 2$ and $j=i+m-1$ where $m>2$, and the q second data lines corresponding to the current first data line are an $(i+m-1)^{th}$ data line, an $(i+2(m-1))^{th}$ data line, an $(i+3(m-1))^{th}$ data line, . . . , an $(i+(q-1)(m-1))^{th}$ data line, and an $(i+q(m-1))^{th}$ data line in turn.

9. The pixel driving circuit according to claim 1, wherein:

the first power supply input terminal of each of the operational amplifiers connected to the first data lines is further connected to a third switch which is connected to the signal control unit;

the signal control unit is further configured to output a first level signal when display is to be performed at the first resolution so that the first level signal controls the third switch to be turned on; and the signal control unit is further configured to output a second level signal when display is to be performed at the second resolution so that the second level signal controls the third switch to be turned off.

10. The pixel driving circuit according to claim 9, wherein:

the first switch is an N-type transistor, the second switch is a P-type transistor, and the third switch is an N-type transistor; or the first switch is a P-type transistor, the second switch is an N-type transistor, and the third switch is a P-type transistor.

11. A pixel driving method applied to the pixel driving circuit according to claim 1, comprising:

controlling, by the signal control unit, the first switch to be turned on and the second switch to be turned off when display is to be performed at the first resolution; and controlling, by the signal control unit, the first switch to be turned off and the second switch to be turned on when display is to be performed at the second resolution.

12. The method according to claim 11, wherein:

the signal control unit outputs a first level signal when display is to be performed at the first resolution, so that the first level signal controls the first switch to be turned on and the second switch to be turned off; and the signal control unit outputs a second level signal when display is to be performed at the second resolution, so that the second level signal controls the first switch to be turned off and the second switch to be turned on.

13. The method according to claim 12, wherein the pixel driving circuit further comprises a third switch, the method comprising:

outputting, by the signal control unit, a first level signal when display is to be performed at the first resolution, so that the first level signal controls the third switch to be turned on; and outputting, by the signal control unit, a second level signal when display is to be performed at the second resolution, so that the second level signal controls the third switch to be turned off.

14. The method according to claim 11, wherein the pixel driving circuit further comprises a source driver configured to control a data line to output a display signal according to an input voltage, the method comprising:

controlling, by the source driver, a $2i^{th}$ data line to output a display signal when the input voltage is a first voltage signal; and controlling, by the source driver, a $(2i+1)^{th}$ data line to output a display signal when the input voltage is a second voltage signal.

15. A display apparatus, comprising the pixel driving circuit according to claim 1.

16. A display apparatus, comprising the pixel driving circuit according to claim 4.

17. A display apparatus, comprising the pixel driving circuit according to claim 5.

18. A display apparatus, comprising the pixel driving circuit according to claim 8.

19. A display apparatus, comprising the pixel driving circuit according to claim 2.

20. A display apparatus, comprising the pixel driving circuit according to claim 9.

* * * * *